US006513305B2

(12) United States Patent
Spatafora

(10) Patent No.: US 6,513,305 B2
(45) Date of Patent: Feb. 4, 2003

(54) WRAPPING METHOD, PARTICULARLY FOR EDIBLE PRODUCTS SUCH AS CHOCOLATES AND THE LIKE, AND THE FINISHED WRAP OBTAINED

(75) Inventor: Mario Spatafora, Bologna (IT)

(73) Assignee: Hershey Foods Corporation, Hershey, PA (US)

( * ) Notice: Subject to any disclaimer, the term of this patent is extended or adjusted under 35 U.S.C. 154(b) by 0 days.

(21) Appl. No.: 09/915,483

(22) Filed: Jul. 26, 2001

(65) Prior Publication Data

US 2002/0022098 A1 Feb. 21, 2002

Related U.S. Application Data

(62) Division of application No. 09/311,739, filed on May 14, 1999, now Pat. No. 6,405,511.

(51) Int. Cl.[7] ..... B65R 61/18

(52) U.S. Cl. ..... 53/412; 53/415; 53/133.7; 53/135.2; 493/212; 493/224; 493/379; 493/923; 493/963

(58) Field of Search ..... 53/412, 415, 133.5, 53/133.6, 133.7, 135.2; 493/212, 225, 223, 224, 345, 347, 348, 377, 378, 923, 930, 963, 379

(56) References Cited

U.S. PATENT DOCUMENTS

| | | | | |
|---|---|---|---|---|
| 1,449,073 A | | 3/1923 | Thom | |
| 2,165,289 A | * | 7/1939 | Milmoe | 53/133.7 |
| 2,177,117 A | | 10/1939 | Potdevin | |
| 2,334,381 A | | 11/1943 | Brongnder | |
| 2,350,244 A | * | 5/1944 | Malhiot | 53/133.7 |
| 2,697,856 A | | 10/1954 | Jensen et al. | |
| 2,725,798 A | | 12/1955 | Vogt | |
| 2,922,342 A | * | 1/1960 | Chalmers | 53/412 |
| 3,045,558 A | * | 7/1962 | Engleson | 493/378 |
| 3,259,031 A | | 7/1966 | Paulson | |
| 3,272,673 A | * | 9/1966 | Focke | 493/378 |
| 3,345,918 A | | 10/1967 | Simeone | |
| 3,346,433 A | * | 10/1967 | Lopez | |
| 3,411,418 A | | 11/1968 | Seragholi | |
| 3,515,037 A | | 6/1970 | Pellaton | |
| 3,654,038 A | * | 4/1972 | Hottendorf | |
| 3,955,481 A | * | 5/1976 | Heitmann | 53/135.2 |
| 4,292,033 A | | 9/1981 | Wolske | |

FOREIGN PATENT DOCUMENTS

| | | |
|---|---|---|
| EP | 315 176 | 5/1989 |
| FR | 1300028 | 12/1962 |

* cited by examiner

*Primary Examiner*—John Sipos
(74) *Attorney, Agent, or Firm*—Paul & Paul

(57) ABSTRACT

Chocolates are wrapped individually by a method that involves feeding single wrapping sheets along a first path in a first direction spaced at a selected pitch, in such a way that the trailing edge of one wrapping sheet and the leading edge of the next are distanced one from another, and at the same time feeding a continuous ribbon in a second direction along a second path that merges with the first path at an assembling station where the ribbon is stably united with the sheets; ribbon and sheet then advance together in a third direction, along which the ribbon is divided into discrete slivers by repeated cuts, each made between the trailing edge of one sheet and the leading edge of the next and at a distance such that each sliver will present a portion projecting from the trailing edge of the wrapping sheet to which it is attached.

10 Claims, 3 Drawing Sheets

WRAPPING METHOD, PARTICULARLY FOR EDIBLE PRODUCTS SUCH AS CHOCOLATES AND THE LIKE, AND THE FINISHED WRAP OBTAINED

CROSS REFERENCE TO RELATED APPLICATIONS

This is a divisional application of U.S. application Ser. No. 09/311,739, filed May 14, 1999, now U.S. Pat. No. 6,405,511 from which a restriction requirement was issued.

BACKGROUND OF THE INVENTION

The present invention relates to a wrapping method, particularly for edible products such as chocolates and the like.

In particular, the present invention relates to a method by which to fashion individual packagings around products, each consisting in a wrapper that comprises a sheet of wrapping material enveloping the product, and a length of narrow ribbon offered to a face of the sheet of material destined to come into contact with the product, in such a way that on completion of the wrapping operation the ribbon is placed internally of the wrapper and in contact with the product.

The ribbon presents an end portion that emerges from the wrapper and can serve as a tab on which to print images and/or text, for example the brand or other indications relating to the packaged product.

This type of wrapping can be used advantageously, in particular, for products exhibiting an irregular and relatively complex geometry.

Indeed if images and/or text were to be printed directly on the outer face of the wrapper in such instances, they would be difficult to decipher and might even be hidden completely between the folds of the sheet when gathered around the product.

A typical example of such wrappings is that used to envelop chocolates of essentially hemispherical shape, where the ribbon is applied to the sheet in such a way that one end emerges from the wrapper at a substantially central area of the hemispherical surface presented by the chocolate.

The conventional wrapping method involves feeding a succession of single wrapping sheets toward an assembling station at which each single sheet is brought to a standstill for a short period of time, sufficient for a ribbon of predetermined length to be placed on the sheet.

The single wrapping sheets are then conveyed in succession together with the respective lengths of ribbon to wrapping means of conventional type by which the sheet and ribbon are folded around the chocolate to fashion the finished wrap.

Such a method dictates a relatively low operating speed, due mainly to the fact that the movement of the wrapping sheets has to be interrupted, albeit briefly, so that the length of ribbon can be placed on each successive sheet.

Moreover, it has been verified through experiment that the method in question will produce a certain percentage of defective wrappers, and therefore of rejects, when the initial position of the ribbon on the sheet is not maintained during the passage of the two elements toward the wrapping means and the ribbon arrives displaced in relation to the sheet from the position originally intended.

This means that in some cases, at the end of the packaging operation, the en d portion of the ribbon fails even to emerge from the wrapper and the brand or text cannot be seen. Another problem is that the ribbon may emerge from the wrapper at a point other than intended, for example at the periphery rather than at the crown of the hemispherical surface. Or again, it can happen that the portion of the ribbon that emerges from the wrapper is not of the length originally intended.

The object of the present invention is to provide a wrapping method unaffected by the aforementioned drawbacks, such as will enable operation at speeds decidedly higher than those allowed by conventional wrapping methods outlined above, and with a notably reduced percentage of rejects in production.

SUMMARY OF THE INVENTION

The stated object is duly realized in a wrapping method according to the invention, in particular for chocolates and the like, which includes the steps of advancing wrapping sheets in an ordered succession along a first path and in a first direction, spaced apart at a predetermined and constant pitch in such a way that the trailing edge of one wrapping sheet and the leading edge of the successive sheet are separated by a predetermined distance; causing a continuous ribbon of minimal transverse dimensions, compared with the transverse dimensions of the wrapping sheet, to advance in a second direction and along a second path merging with the first path at an assembling station; associating and stably uniting the ribbon with the wrapping sheets and advancing the ribbon as one with the single sheets in a third direction; cutting the continuous ribbon transversely at a point between the trailing edge of one wrapping sheet and the leading edge of a successive sheet advancing in the third direction so as to generate discrete slivers of ribbon, and in such a manner that a portion of each sliver projects from the trailing edge of the respective sheet; directing the wrapping sheets in ordered succession, each associated with a relative sliver of ribbon, toward wrapping means; and directing an ordered succession of products for wrapping toward the wrapping means, synchronously with the wrapping sheets.

The present invention also relates to a finished wrap, in particular for edible products such as chocolates and the like.

A finished wrap for an edible product according to the invention comprises a wrapper fashioned from a wrapping sheet folded in such a way as to envelop the product, and a sliver of ribbon presenting minimal transverse dimensions compared with the transverse dimensions of the wrapping sheet; in the wrap disclosed, the sliver of ribbon is united stably to the face of the wrapping sheet destined to make contact with the product and presents at least one end portion projecting from the finished wrap.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
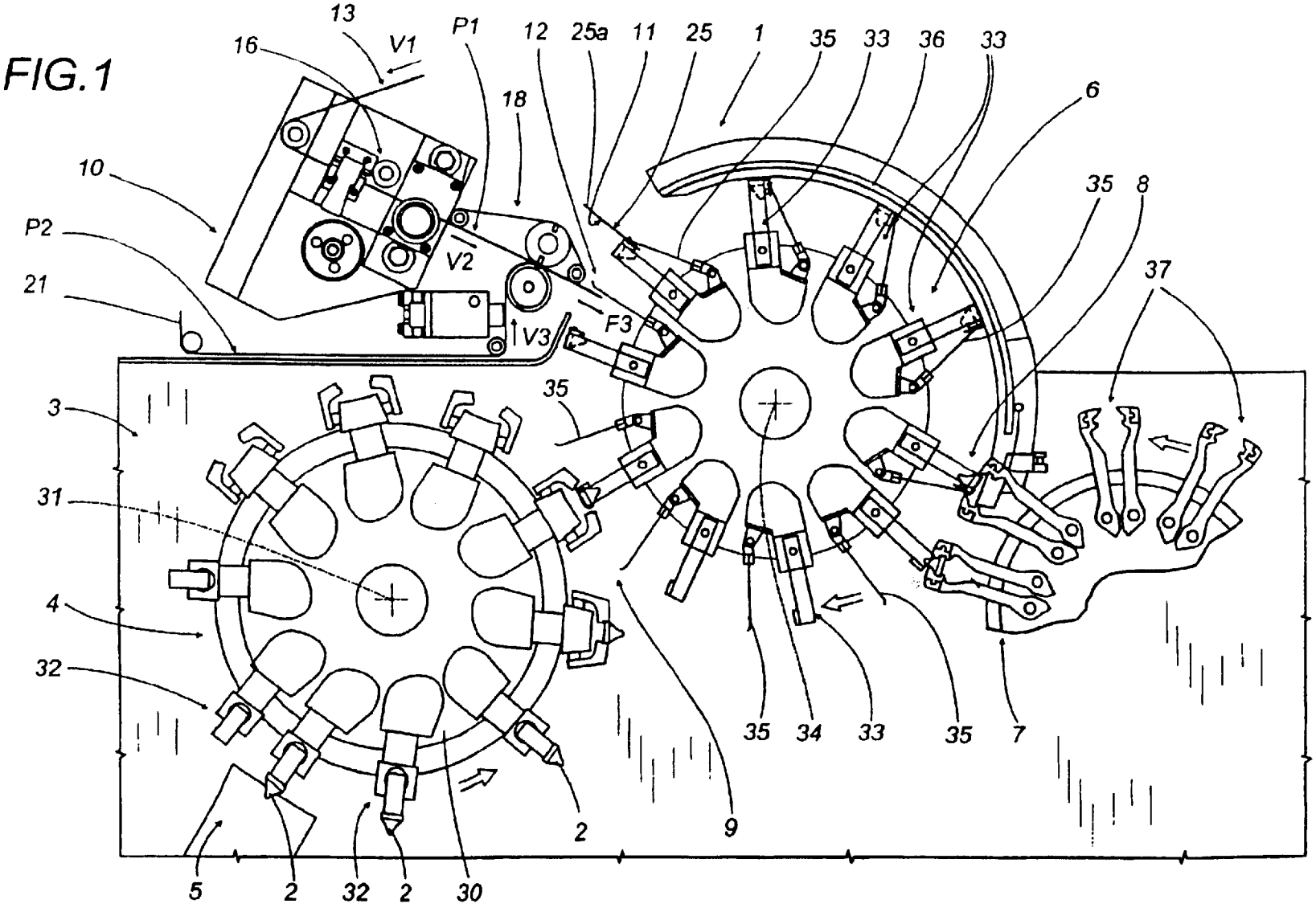
FIG. 1 shows part of a packaging device according to the present invention, viewed in elevation and in a preferred embodiment.
Figure 2:
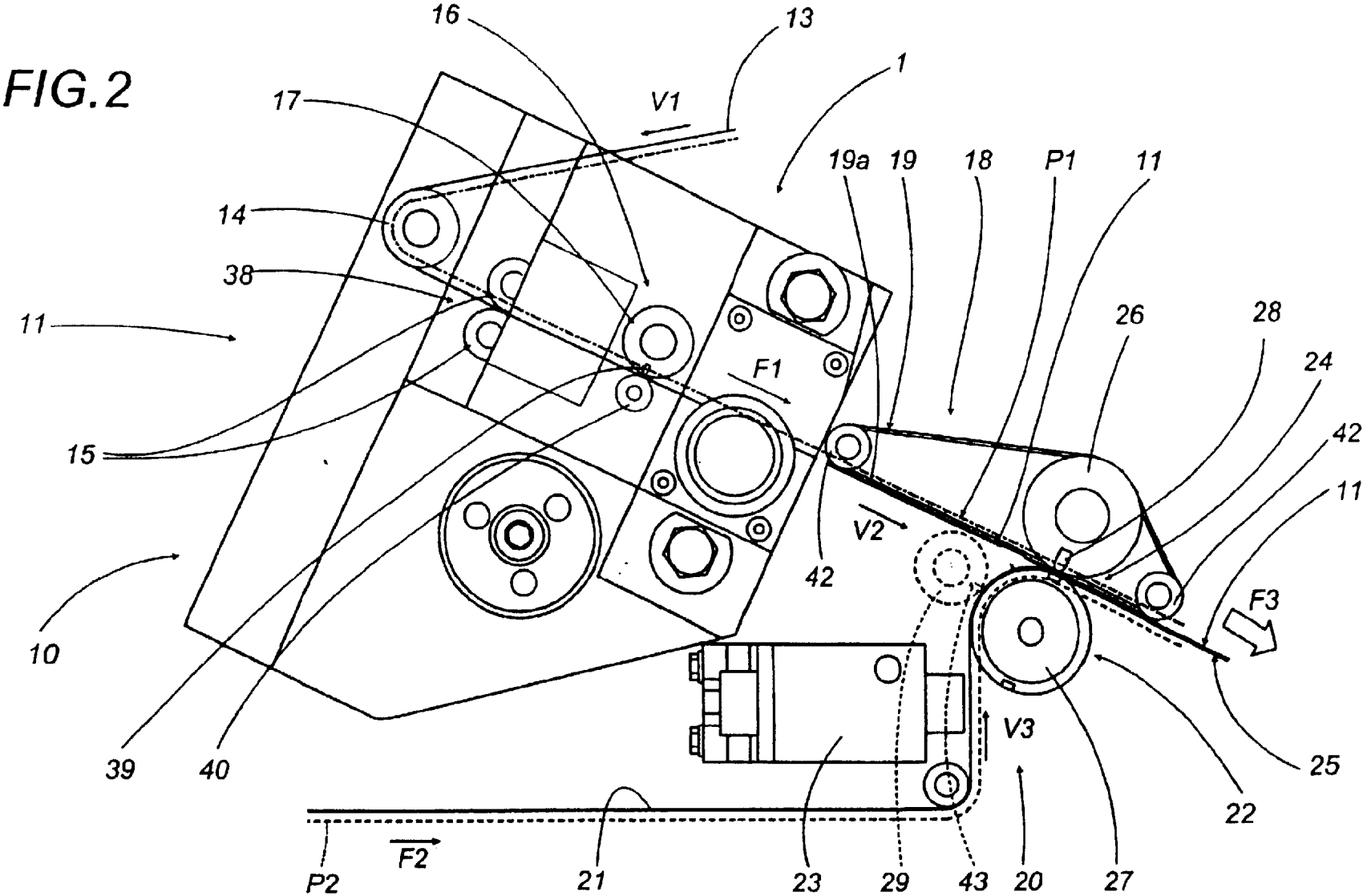
FIG. 2 shows an enlarged detail of FIG. 1.

With reference to FIGS. 1 and 2 of the drawings, 1 denotes a packaging device, in its entirety, for wrapping edible products consisting, in the example illustrated, of chocolates 2 appearing essentially hemispherical or domed in shape.

The device 1 exhibits a frame having a vertical front wall 3 and operates in conjunction with a feed unit of conventional type (not illustrated) converging on the wall, by which chocolates 2 are supplied to the device in an ordered succession.

The packaging device is equipped with a transfer device 4 by which the chocolates 2 are taken up singly and in succession from the aforementioned feed unit at an infeed station 5.

The device 1 comprises a first wrapping drum 6 and a second wrapping drum 7 of conventional type, indicated only in part, which are disposed mutually tangential at a transfer station 8. Chocolates 2 are passed singly and in succession by the transfer device 4 to the first drum 6 at a further transfer station 9.

Still in FIGS. 1 and 2, the packaging device 1 also comprises a device 10 serving to feed and to cut a continuous strip 13 of wrapping material.

The device 10 is equipped with relative decoiling means 38 of conventional embodiment by which the strip 13 of wrapping material is drawn from a roll (not shown) and advanced in a first direction F1 along a first predetermined path P1. The decoiling means 38 comprise a freely revolving idle roller 14 around which the strip 13 is routed initially, also a pair of pinch rolls 15 located one on either side of the first path P1, at least one power driven, by which the strip 13 is caused to advance along the selfsame path P1 at a first linear velocity V1.

Figure 3A:
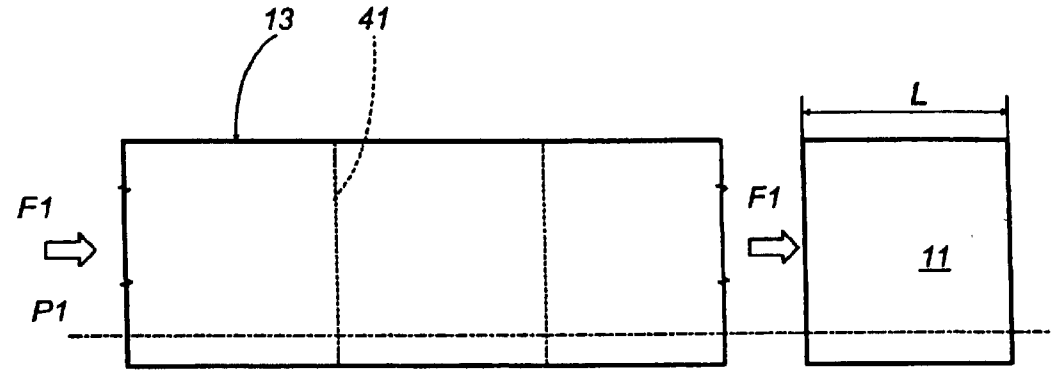
FIGS. 3*a,* 3*b* and 4 are schematic representations of two steps in a wrapping method according to the present invention.

Referring to FIG. 2 and FIG. 3*a,* the continuous strip 13 of wrapping material, perhaps a metal foil paper suitable for chocolates 2, is advanced by the pinch rolls 15 toward a cutter unit 16 comprising at least one roller 17 equipped with a knife 39, and a reaction roller 40 positioned on the side of the strip 13 opposite from the knife roller 17. The knife 39 operates in conjunction with the reaction roller in such a manner as to sever the strip 13 transversely on cutting lines denoted 41 and thus generate single wrapping sheets 11 of predetermined length L, measured parallel to the feed path P1.

The feed and cut device 10 is embodied in such a way as to supply an ordered succession of wrapping sheets 11 toward the first drum 6 and into a pickup station 12, where the single sheets are joined with respective chocolates 2 supported and conveyed by the selfsame first drum 6. More exactly, observing FIGS. 2 and 3*b,* the device 10 comprises first feed means 18 located beyond the cutter unit 16 in the feed direction F1, by which the successive single sheets 11 emerging from the unit 16 are taken up and advanced along the first path P1 more quickly, accelerating to a second linear velocity V2 higher than the first velocity V1.

In this way, sheets 11 taken up by the first feed means 18 advance singly and in ordered succession along the first path P1 spaced apart at a constant pitch denoted P, with the trailing edge 11*a* of one sheet 11 separated from the leading edge 11*b* of the next by a predetermined distance D.

The first feed means 18 incorporate at least one endless conveyor belt 19 looped around respective pulleys 42 (of which at least one is power driven) and comprising an active branch 19*a* connected in conventional manner to suction means not indicated in the drawings; the active branch 19*a* of the belt is associated operatively along the feed path P1 with the wrapping sheets 11, which are taken up one by one and advanced in the feed direction F1 at the second linear velocity V2 aforementioned.

The feed and cut device 10 also comprises second feed means 20 of which the function is to advance a continuous ribbon 21 presenting minimal transverse dimensions, compared with the transverse dimensions of the strip 13 of wrapping material. The ribbon 21 might be of paper, for example, and printed with images and/or text such as the brand and/or other matter pertinent to the chocolates 2 being wrapped. The second feed means 20 are designed to decoil the ribbon 21 from a roll (not illustrated) and advance it along a second predetermined path P2 in a second feed direction F2 at a linear velocity V3 identical to the second linear velocity V2 of the sheets 11 conveyed by the first feed means 18.

The second feed means 20 operate in conjunction with the first feed means 18 in the vicinity of an assembling station 22 where the path P2 followed by the ribbon 21 merges with the path P1 followed by the wrapping sheets 11 in such a manner that the ribbon 21 is caused to associate stably with the sheets 11, creating a sheet-ribbon assembly which is then advanced along a common feed direction F3.

Figure 3B:
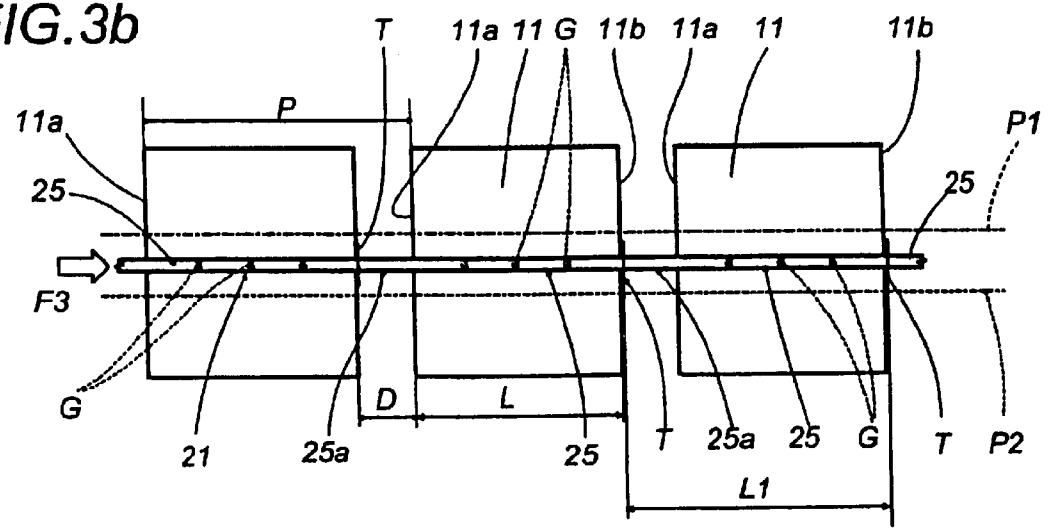

As discernible in FIGS. 2 and 3*b,* the feed and cut device 10 incorporates a gumming device 23 located on the second feed path P2 at a station preceding the assembling station 22, of which the function is to apply an adhesive material G at predetermined and distinct points along the advancing ribbon 21. More exactly, dabs of adhesive G are distributed along the face of the ribbon 21 destined to enter into contact with the wrapping sheets 11, in such a way that the ribbon and the sheets advancing along their respective feed paths P1 and P2 will stick together.

Observing FIG. 3*b,* the ribbon 21 will be seen to coincide substantially with the median axis of the wrapping sheets 11.

Also operating at the assembling station 22 is a device 24 by which successive transverse cuts T are made through the continuous ribbon 21 to produce discrete slivers 25 of a predetermined length L1 greater, in the particular example of FIG. 3*b,* than the length L of the sheets 11.

The action of the cutter device 24 can be timed with that of the second feed means 20 advancing the ribbon 21 and of the first feed means 18 advancing the sheets 11, in such a way that each cut T made through the ribbon 21 is substantially adjacent to the leading edge 11*b* of a sheet 11 advancing along the feed path P1 behind the sheet 11 with which the ribbon 21 has been stably associated previously. Accordingly, the sliver 25 of ribbon glued to each sheet 11 appears with an end portion 25*a* projecting from the trailing edge 11*a* of the sheet.

The ribbon cutter device 24 comprises a pair of rollers 26 and 27, located on opposite sides of the first and second paths P1 and P2 and contrarotating about parallel axes, between which the sheets 11 and the ribbon 21 are directed already positioned in mutual and stable contact.

It will be seen from FIG. 2 that the periphery of the one roller 26, positioned on the side of the first path P1 occupied by the first feed means 18, is equipped with at least one blade 28 that strikes against the remaining roller 27 of the device 24 to cut through the ribbon 21.

In the example of FIG. 2, the cutter roller 26 is located internally of the looped suction belt 19, which can be embodied with openings (not indicated) located at selected points timed to coincide with the passage of the blade 28 in such a way that the roller 26 will be able to cut the ribbon 21 whilst avoiding interference with the belt 19.

The cutting roller 26 is proportioned in such a manner that the blade 28 will cut the ribbon 21 at a point adjacent to the leading edge 11*b* of each sheet 11 passing through the assembling station 22.

The roller denoted 27, significantly, in addition to providing a striking surface for the blade 28 of the cutter roller 26, could serve at the same time as a roller about which and by which the ribbon 21 can be wrapped partially and advanced, and could therefore function as the second feed means 20. Also forming part of the device 1 are monitoring and control means (not illustrated) by which the feed and cut device 10, the means 38 by which the strip 13 is decoiled, the first and second feed means 18 and 20 advancing the sheets 11 and the ribbon 21, the strip cutter unit 16, the gumming device 23 and the means for cutting the ribbon 21 into discrete slivers 25 are all synchronized in operation one with another.

Figure 4:
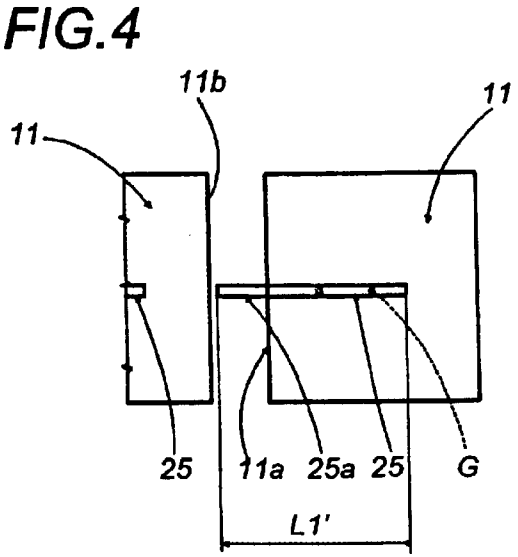

In an alternative embodiment of the device 1, the roller 27 which affords the striking surface could operate in conjunction with an additional roller 29 indicated by phantom lines in FIG. 2, positioned on the side of the second path P2 opposite from the roller 27 and equipped with a blade denoted 43. The two rollers 29 and 27 combine to cut the ribbon 21 into discrete lengths which are then carried by the latter roller 27 toward the assembling station 22. With this type of solution, the slivers 25 glued to the sheets 11 in the manner described above are of length L1' not necessarily greater, but possibly less than or equal to the length L of the sheet 11, as illustrated in FIG. 4. Likewise in this instance, the sliver 25 will present a portion 25*a* projecting from the trailing edge 11*a* of the sheet 11 to which it is affixed.

The function of the feed and cut device 10 is to supply sheets 11 continuously to the first wrapping drum 6 in ordered succession, gluing a sliver 25 of ribbon 21 to each one in turn.

The function of the two wrapping drums 6 and 7 is to join each single chocolate 2 with a respective sheet 11 affording a relative sliver 25, and then fold the sheet 11 around the chocolate 2 to form a wrapper 45 appearing substantially as a bundle, by which the chocolate is completely enveloped.

The wrapping operation is effectuated by the wrapping means in such a manner that most of the sliver 25 of ribbon remains inside the wrapping, with only the end portion 25*a* protruding.

Figure 5:
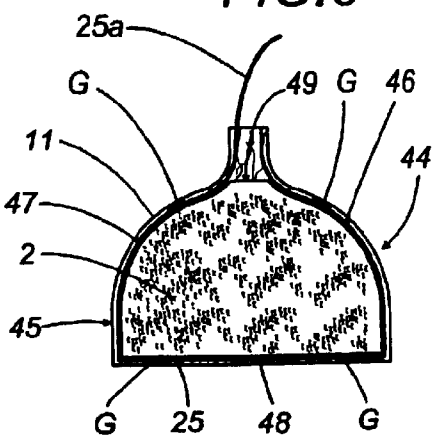
FIG. 5 illustrates a finished wrap for a product wrapped by the method according to the invention, viewed schematically and in section.

FIG. 5 illustrates an example of the wrapper 45 obtained with the device 1 disclosed, in which the finished wrap, denoted 44 in its entirety, appears with the sheet 11 gathered about and enveloping the chocolate 2, the sliver 25 of ribbon having been glued to the inside face of the sheet and correctly placed in order to assume a configuration passing around the chocolate 2 with the end portion 25*a* projecting from the topmost part of the finished wrap 44.

In a typical embodiment, the chocolate 2 presents a geometry characterized by at least one surface of revolution 46; in this instance the sliver 25 of ribbon is disposed in contact with the chocolate 2 along at least a part of one generator of this same surface of revolution 46.

In the case of a chocolate 2 having an appearance characterized by a substantially hemispherical or domed lateral surface of revolution 47, and a flat base 48, the sliver 25 of ribbon is disposed in contact with the chocolate 2 along at least a part of one meridian line presented by the hemispherical surface of revolution 47. Wrapping a chocolate 2 of this particular shape, the sliver 25 of ribbon can be disposed in contact with the lateral surface 47 along at least a part of one meridian line, and in contact with the base 48 likewise along at least one part.

Finally, the sliver 25 of ribbon could extend along the entire peripheral outline presented by a given section of the chocolate 2.

Packaging chocolates 2 or candies that present a substantially hemispherical or domed shape, the end portion 25*a* emerges from the finished wrap 44 at the crown 49 of the substantially hemispherical or domed surface 47 of the chocolate 2.

To reiterate, the thin sliver 25 of ribbon 21 is caused to associate permanently with the face of the wrapping sheet 11 offered to the chocolate 2 by interposing least one layer of adhesive material G, applied continuously along the full length of the sliver 25 placed in contact with the sheet 11, or as a series of dabs at predetermined and selected points.

Observing FIG. 1, the transfer device 4 will be seen to comprise a drum 30 rotatable 31 counter-clockwise about a horizontal axis 31 and furnished with a plurality of pickup and transfer units 32 uniformly distributed about the relative axis 31 of is rotation.

The function of the aforementioned units 32 is to pick up single chocolates 2 from the feed unit at the infeed station 5 and transfer them to gripping means afforded by the first wrapping drum 6.

The first drum 6 is carried by the vertical front wall 3 and rotatable in the clockwise direction at a substantially constant angular velocity about a horizontal axis 34 disposed parallel to the axis 31 of the transfer drum 30. The first wrapping drum 6 is equipped with a plurality of gripper devices 33 distributed uniformly about the axis 34 of rotation and designed each to hold one chocolate 2. The drum also carries a plurality of jaws 35 each associated with a respective gripper device 33, of which the function is to take up the wrapping sheets 11 from the feed and cut device 10. The drum 6 is compassed peripherally between the pickup station 12 and the transfer station 8 by a fixed restraint 36.

The restraint 36 combines with the first wrapping drum 6 in conventional manner to bend each wrapping sheet 11 through a right angle around the relative chocolate 2.

The second drum 7 is supported by the vertical wall 3 and rotatable thus counter-clockwise at a substantially constant angular velocity about a horizontal axis not indicated but disposed likewise parallel to the axis 31 of the transfer drum 30.

The second wrapping drum 7 is equipped similarly with a plurality of gripper devices 37 distributed uniformly about the axis of the drum 7 and designed each to hold one chocolate 2.

Each wrapping sheet 11 is folded to a U profile in familiar fashion about the relative chocolate 2 during the transfer from the first wrapping drum 6 to the second wrapping drum 7. The chocolates 2 are then conveyed in conventional manner by the second drum 7 along a circular path and through a closing station (conventional, and not illustrated) where each sheet 11 is gathered in around the respective chocolate 2 to produce a wrapper 45 characteristic of the finished wrap 44 illustrated in FIG. 5.

The operation of the transfer drum 6 and of the first and second wrapping drums 6 and 7 is embraced by the prior art, and accordingly, the remainder of the specification will be limited to describing the operation of the feed and cut device 10.

In operation the strip 13 of wrapping material is received by the device 10 and fed continuously by the pinch rolls 15 to the cutter unit 16, advancing along the first path P1 in the first direction F1 at the aforementioned first linear velocity V1. The wrapping sheets 11 emerging from the cutter unit 16 are taken up in succession by the suction belt 19 and accelerated to the second linear velocity V2.

In the course of this step, the trailing edge 11*a* of each successive sheet 11 will be separated from the leading edge 11*b* of the next by a predetermined distance D so as to establish the required pitch P. At the same time, the ribbon 21 is directed toward the assembling station 22 along the second path P2 at a linear velocity V3 identical to the second linear velocity V2 of the sheets 11.

As the ribbon 21 advances, a layer of adhesive G is applied by the gumming device 23, operating at a station that precedes the assembling station 22 as illustrated in FIG. 2, to predetermined and distinct points on the face destined to enter into contact with the wrapping sheet 11.

The ribbon 21 and wrapping sheets 11 are joined in mutual contact at the assembling station 22 and directed thus through the rollers 26. The blade 28 of the cutter roller 26 divides the ribbon 21 into slivers 25, making transverse cuts T each of which coincides with the leading edge 11*b* of an advancing sheet 11. The assembly formed by each sheet 11 and sliver 25 of ribbon bonded thus together is made to advance along a common direction F3, passing from the feed and cut device 10 to the first wrapping drum 6, and taken up in conventional manner by the jaws 35 of the drum.

Finally the sheet 11 and the associated sliver 25 are wrapped around the chocolate 2 to obtain the finished wrap 44 illustrated in FIG. 5.

What is claimed is:

1. A method of wrapping edible products comprising the steps of advancing wrapping sheets in an ordered succession along a first path and in a first direction, spaced apart at a predetermined and constant pitch in such a way that the trailing edge of one wrapping sheet and the leading edge of the successive sheet are separated by a predetermined distance; causing a continuous ribbon of minimal transverse dimensions, compared with the transverse dimensions of the wrapping sheet, to advance in a second direction and along a second path; cutting the continuous ribbon to produce discrete slivers and advancing each sliver along the second path toward an assembling station where the second path merges with the first path; associating and stably uniting each sliver of ribbon with a respective sheet in such a manner that each sliver presents a portion projecting from the trailing edge of the corresponding sheet; directing the wrapping sheets in ordered succession, each associated with a relative sliver of ribbon, in a third direction, toward wrapping means; and directing an ordered succession of products for wrapping toward the selfsame wrapping means, synchronously with the wrapping sheets.

2. A method as in claim 1, wherein the stable association between the ribbon and the wrapping sheets is brought about by including a step of sealing the ribbon to the wrapping sheet.

3. A method as in claim 2, wherein the sealing step includes a subsidiary step of interposing a layer of adhesive material between the ribbon and the sheet.

4. A method as in claim 2, wherein the sealing step includes a subsidary step of applying a layer of adhesive material at least to a face of the ribbon which contacts with a relative wrapping sheet.

5. A method as in claim 4, wherein the subsidiary step of applying a layer of adhesive material is effected by dispensing the selfsame adhesive material at predetermined and distinct points along the ribbon.

6. A method as in claim 4 or claim 5, wherein the subsidiary step of applying a layer of adhesive material is effected, with the ribbon advancing, at a location on the second path preceding the joining station in the second direction.

7. A method as in any one of claims 2 to 5, wherein the step of advancing the wrapping sheets along the first path is preceded by the steps of directing a continuous strip of wrapping material along a predetermined path toward a unit by which the strip is cut; severing the continuous strip transversely by means of the cutter unit in such a way as to obtain wrapping sheets of predetermined length, presenting a leading edge and a trailing edge, which are caused to advance in an ordered succession along the first path; and accelerating the sheets along the first path in such a way as to establish a predetermined pitch whereby the trailing edge of one wrapping sheet is distanced from the leading edge of the next sheet in succession.

8. A method as in any one of claims 2 to 5, wherein the ribbon is divided into slivers by successive cuts made each in close proximity to the leading edge of a wrapping sheet.

9. A method as in claim 6, wherein the step of advancing the wrapping sheets along the first path is preceded by the steps of directing a continuous strip of wrapping material along a predetermined path toward a unit by which the strip is cut; severing the continuous strip transversely by means of the cutter unit in such a way as to obtain wrapping sheets of predetermined length, presenting a leading edge and a trailing edge, which are caused to advance in an ordered succession along the first path; and accelerating the sheets along the first path in such a way as to establish a predetermined pitch whereby the trailing edge of one wrapping sheet is distanced from the leading edge of the next sheet in succession.

10. A method as in claim 6, wherein the ribbon is divided into slivers by successive cuts made each in close proximity to the leading edge of a wrapping sheet.

* * * * *